US005223694A

United States Patent [19]

Tsuji et al.

[11] Patent Number: 5,223,694

[45] Date of Patent: Jun. 29, 1993

[54] HAIR STYLING IRON FOR STRAIGHTENING AND CURLING

[75] Inventors: Eiji Tsuji; Hiroshi Nanba, both of Hikone; Manabu Takeda; Katsunori Someya, both of Yokohama, all of Japan

[73] Assignee: Matsushita Electric Works, Ltd., Osaka, Japan

[21] Appl. No.: 826,440

[22] Filed: Jan. 27, 1992

[30] Foreign Application Priority Data

Jan. 28, 1991 [JP] Japan ..... 3-8760

[51] Int. Cl.[5] ..... A45D 1/04; A45D 1/14; H05B 3/00

[52] U.S. Cl. ..... 219/225; 132/118; 132/224; 132/232; 219/230; 392/395

[58] Field of Search ..... 219/222–225, 219/230; 132/224, 225, 232, 117, 118; 392/395

[56] References Cited

U.S. PATENT DOCUMENTS

| | | | |
|---|---|---|---|
| 943,321 | 12/1909 | Shero | 132/224 |
| 1,362,892 | 12/1920 | Pace | 219/225 X |
| 1,588,241 | 6/1926 | Leland | 132/224 |
| 1,909,894 | 5/1933 | Protzky | 132/224 |
| 1,937,004 | 11/1933 | Anderson | 132/118 |
| 2,103,676 | 12/1937 | Karasiewicz | 132/225 |
| 2,243,635 | 5/1941 | Karasiewicz | 132/225 |
| 3,102,941 | 9/1963 | Pope | 132/232 |
| 4,192,328 | 3/1980 | Barradas et al. | 219/225 X |
| 4,479,047 | 10/1984 | Khaja et al. | 132/232 X |
| 4,565,916 | 1/1986 | Tsuji et al. | 219/225 |
| 4,739,151 | 4/1988 | Smal | 219/225 |

FOREIGN PATENT DOCUMENTS

| | | | |
|---|---|---|---|
| 1065401 | 1/1954 | France | 219/225 |

*Primary Examiner*—Anthony Bartis

*Attorney, Agent, or Firm*—Stevens, Davis, Miller & Mosher

[57] ABSTRACT

A hair styling iron for selectively effecting hair straightening or curling includes a generally circular cross-section electrically heated barrel. A tongue is movable relative to the barrel for selectively clamping a strand of hair between the tongue and the peripheral surface of the barrel for curling hair wound therearound. The barrel comprises a first and second pipes each having a generally semi-circular cross section with a top rounded outer surface and a flat bottom outer surface. The pipes are movable relative to each other between a closed position where the flat bottom surfaces are kept in closed relation to each other and an open position where the bottom surfaces are spaced away from each other. In the closed position, a strand of hair can be held between the opposing flat bottom surfaces of the first and second pipes in order to substantially straighten or uncurl the hair. Thus, the hair styling iron can alone provides hair curling and straightening capabilities.

6 Claims, 8 Drawing Sheets

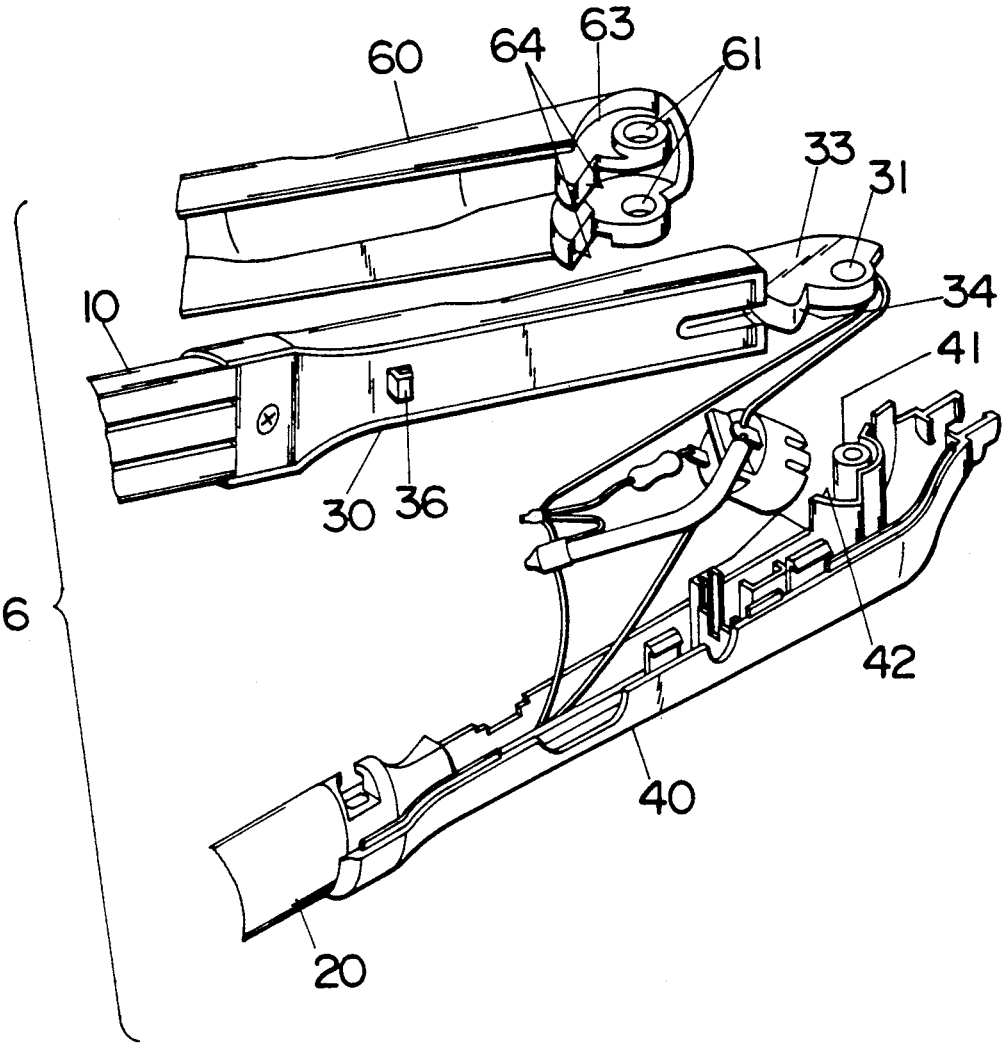
Fig.6
Fig.7
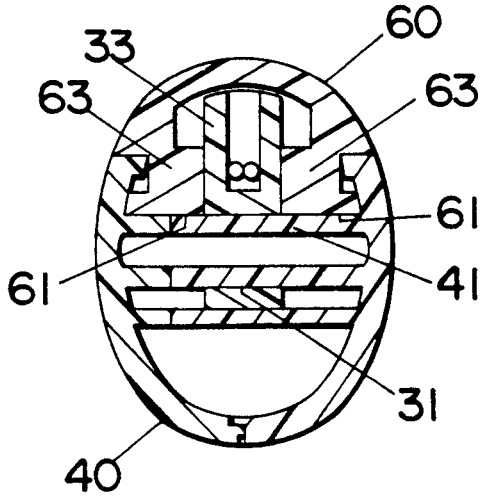

HAIR STYLING IRON FOR STRAIGHTENING AND CURLING

BACKGROUND OF THE INVENTION

1. Field of the Invention

The present invention is directed to a hair styling iron with hair curling and straightening capabilities.

2. Description of the Prior Art

Various types of hair styling irons have been widely available and are generally classified into two types, one for hair curling and the other for hair straightening. That is, the prior hair styling irons have been designed specifically to perform either the hair curling or hair straightening. Consequently, the user is required to use different types of the hair styling irons depending upon the desired hair styling, i.e., hair curling and straightening. This is very inconvenient and cost-consuming for the user. There has also been known in the art a hair styling iron having a dual hair styling capabilities, as shown in U.S. Pat. No. 4,739,151. The patent discloses a hair styling iron which provides two different hair clamping sections of different hair contacting surfaces in order to selectively effect styling the hair into different configuration. However, due to the lack of any cylindrical barrel for winding the hair and also to the structural limitation in this patent that the hair is always clamped between two opposing plates, it is not possible to curl the hair as expected by a conventional hair curling iron with a cylindrical barrel, although the hair can be successfully waved or straightened. In this sense, this patent also fails to selectively curl and straighten the hair.

SUMMARY OF THE INVENTION

In view of the inconvenience seen in the prior art hair styling irons, the present invention is contemplated to a hair styling iron which has dual capabilities of curling and straightening the hair. The hair styling iron in accordance with the present invention comprises a barrel incorporating a heater and configured to have a generally circular cross section. A hair clamping tongue is movable relative to the barrel between a clamping position of clamping a strand of hair between the tongue and a peripheral portion of the barrel in order to curl the hair wound around the barrel in cooperation with the heater. The barrel comprises a pair of first and second pipes each having a generally semi-circular cross section with a top rounded outer surface and a bottom outer surface. The first and second pipes are movable relative to each other between a closed position where the outer bottom surfaces of the first and second pipes are kept in closed relation to each other and an open position where the outer bottom surfaces are kept away from each other. At the closed position, a strand of hair can be held between the opposing bottom outer surfaces of the first and second pipes in order to straighten or uncurl the hair in cooperation with the heater. Thus, the hair curling and straightening can be selectively and conveniently effected with a single device.

Accordingly, it is a primary object of the present invention to provide a hair styling iron which is capable of providing hair curling and straightening capabilities for enhanced convenience.

The first and second pipes extends respectively from one of the ends of first and second handles which are pivotally connected at their other ends about a pivot axis so that the first and second pipes are allowed to pivot together with the first and second handles about the pivot axis. The hair clamping tongue is also pivotally supported about the common pivot axis so as to be capable of pivoting together therewith as well as independently therefrom. Thus, when performing hair curling, the hair clamping tongue is made to pivot separately from the first pipe as well as the second pipe for facilitating clamping the hair between the first pipe and the tongue. On the other hand, when performing the hair straightening, the tongue is made to pivot together with the first pipe relative to the second pipe for facilitating to holding the hair between the first and second pipes.

It is therefore another object of the present invention to provide a hair styling iron in which the hair clamping tongue can be made pivotable together with or separately from the first pipe for facilitating hair curling and straightening operations.

In order to further facilitate the handling of the hair clamping tongue and the first pipe in opening and closing relative to the first pipe and the second pipe, respectively, the hair clamping tongue and the first pipe are spring-biased to a release position and an open position, respectively. The hair clamping tongue and the first pipe are capable of being locked in a clamping position or a closed position, respectively by clamp lock means and barrel lock means. Thus, the hair clamping tongue can be kept at its clamping position on the first pipe so as not to be a hindrance to the hair straightening operation by the first and second pipes, while the first and second pipes are kept in the closed position to constitute a barrel for enabling hair curling in cooperation with the hair clamping tongue. With the provision of the lock means, the device can be more conveniently utilized to selectively perform hair curling and straightening operations, which is therefore a further object of the present invention.

Provided at the tip of the first pipe is a water supply means containing a volume of water and means for feeding the water to a heater accommodated within the first pipe. The heater generates steam which is fed outwardly through a number of vents formed in the surface of the first pipe. In order to contain a large volume of water in the water supply means at the tip of the first pipe, the first pipe is configured to have a cross section larger than the second pipe.

It is therefore a still further object of the present invention to provide a hair styling iron which is capable of generating the steam for effectively performing hair curling and straightening.

These and still other objects and advantageous features of the present invention will become more apparent from the following detailed description of the embodiments when taken in conjunction with the attached drawings.

BRIEF DESCRIPTION OF THE DRAWINGS

FIG. 6 is an exploded perspective view illustrating a structure of pivotally coupling the first handle as well as a clamp handle of the clamping tongue to a second handle carrying a second pipe;

FIG. 7 is a sectional view along line 7—7 of FIG. 4 illustrating the above pivot coupling;

DETAILED DESCRIPTION OF THE EMBODIMENTS

First Embodiment <FIGS. 1 to 12>

Figure 1:
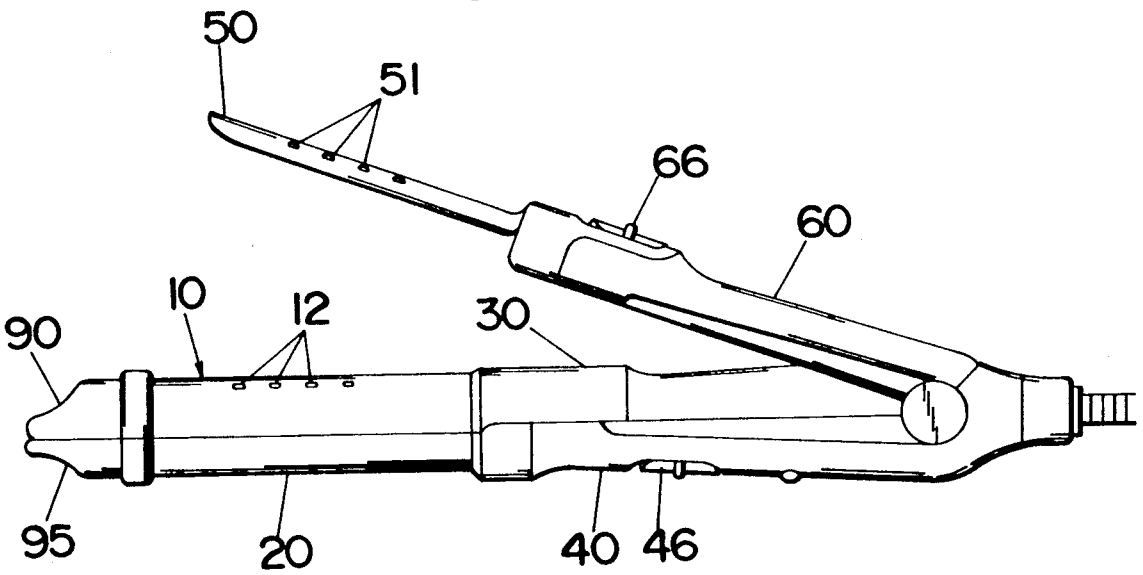
FIG. 1 is a front view of a hair styling iron, shown with a hair clam in its release position ready for curing the hair, in accordance with a first embodiment of the present invention.
Figure 2:
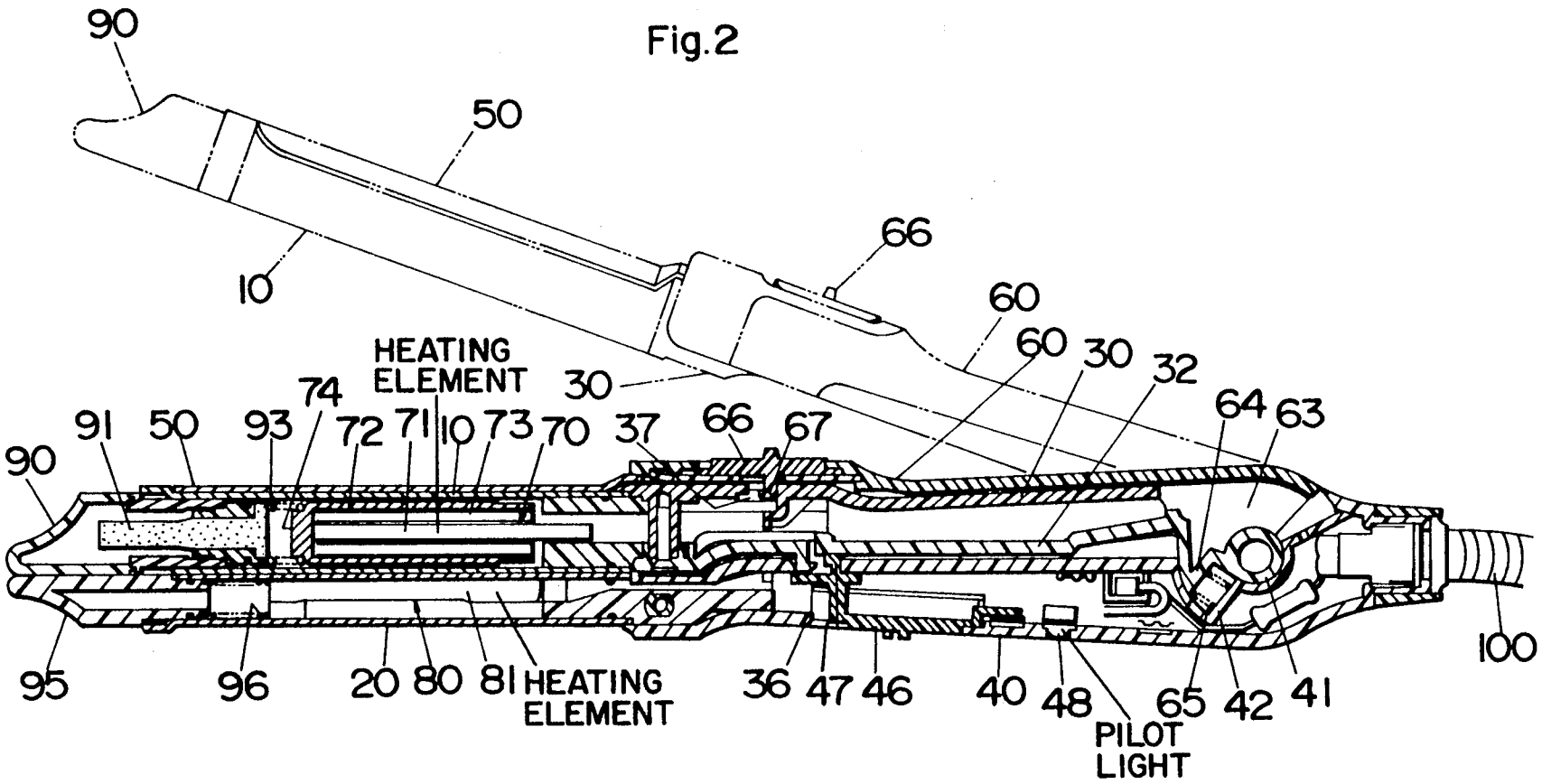
FIG. 2 is a vertical section of the hair styling iron FIG. 1.
Figure 3:
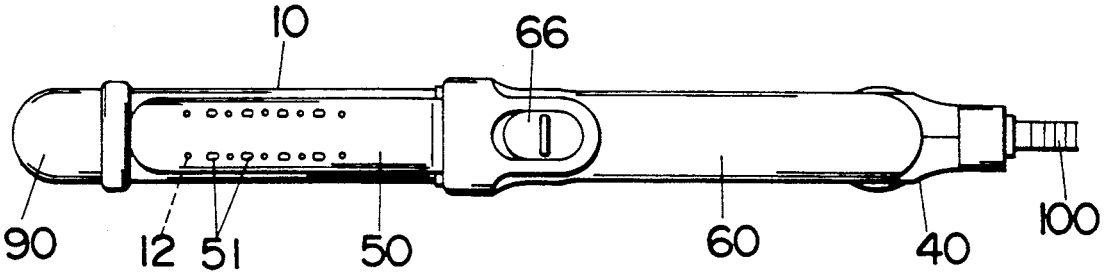
FIGS. 3 and 4 are top and bottom views of the hair styling iron, respectively.
Figure 4:
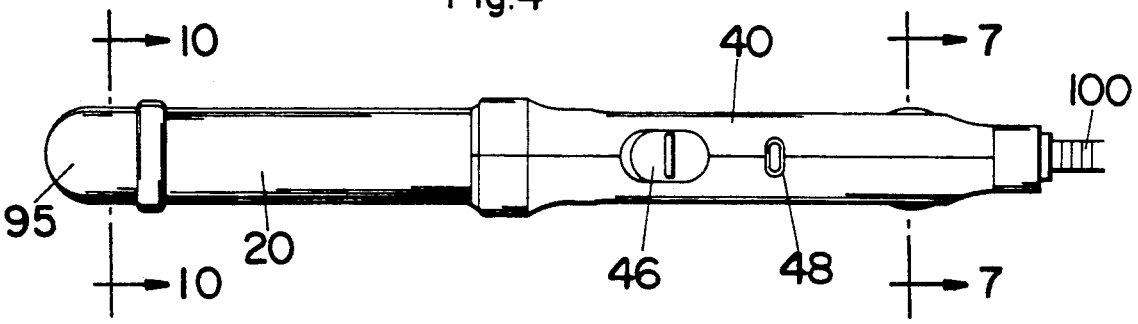
Figure 10:
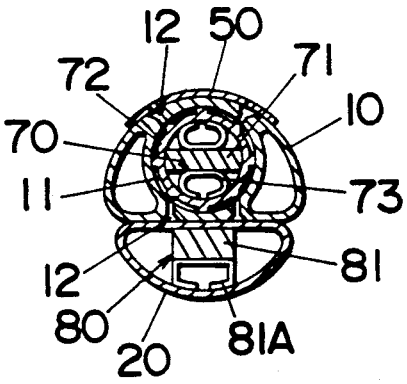
FIG. 10 is a cross-section along line 10—10 of the hair styling iron illustrating a water tank and its associated parts at the tip of the hair styling iron.

Referring now to FIGS. 1 and 2, there is shown a hair styling iron in accordance with a first embodiment of the present invention. The hair styling iron comprises a pair of first and second pipes 10 and 20 each having a generally semi-circular cross section with a top rounded outer surface and a bottom outer surface. The first and second pipes 10 and 20 extend straight from front ends of first and second handles 30 and 40, respectively. The first and second handles 30 and 40 are pivotally connected at the rear ends thereof so that the first and second pipes are movable between a closed position of FIG. 1 (also shown by solid lines of FIG. 2) and an open position of FIG. 11 (also shown by dotted lines of FIG. 2). At the closed position, the first and second pipes 10 and 20 have their bottom outer surfaces kept in closed relation to each other to define a cylindrical barrel about which a strand of hair is wound. Also in this closed position, the hair is allowed to be held between the first and second pipes 10 and 20 so as to be properly styled therebetween by the effect of heat applied to the contacting surfaces of the first and second pipes 10 and 20. In this embodiment, the outer bottom surfaces of the first and second pipes 10 and 20 are of generally flat configuration, as shown in FIG. 10, in order to straighten the hair between the outer bottom surfaces. It is noted here that the outer bottom surfaces may be suitably rounded or curved at a gradual curvature different from the top rounded surface for desired hair styling.

Also included in the hair styling iron is a hair clamping tongue 50 which extends straight from a front end of a corresponding clamp handle 60. The clamping tongue 50 extends by substantially the same length as the first pipe 10 and is configured to have an arcuately curved cross section in conformity with the top rounded top surface of the first pipe 10 so as to be tightly placed thereupon over the substantially the full length of the first pipe 10. The clamp handle 60 is pivotally supported at its rear end to the first and second handles 30 and 40 so that the hair clamping tongue 50 is movable relative to the top rounded outer surface between a clamping position of clamping therebetween the strand of hair wound about the barrel and a release position which permits the strand of hair to be unwound. Thus, the hair can be curled between the clamping tongue 50 and the barrel in cooperation of the heat applied thereto. The first and second pipes 10 and 20 incorporate first and second heaters 70 and 80, respectively to apply heat to the hairs held between the first and second pipes 10 and 20 for hair straightening as well as the hairs clamped between the first pipe 10 and the clamping tongue 50 for hair curling.

Figure 5:
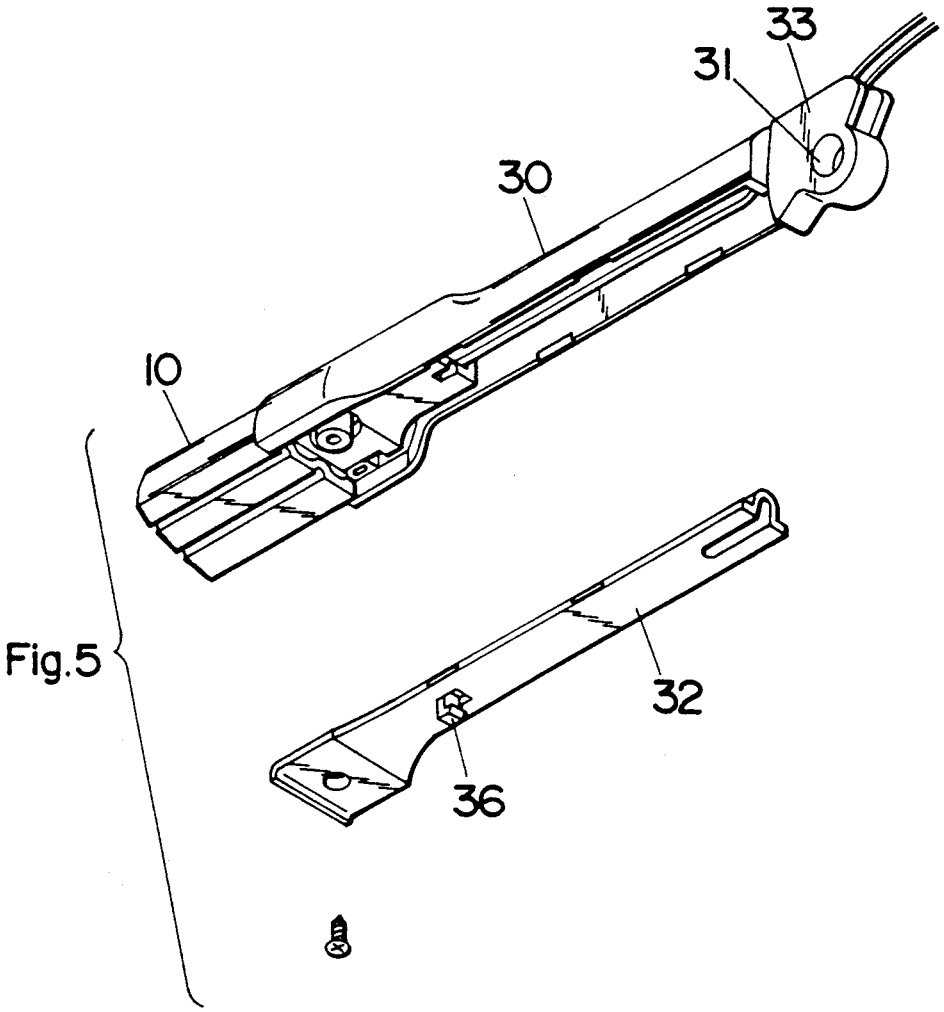
FIG. 5 is an exploded perspective view of a first handle employed in the hair styling iron to carry a first pipe.
Figure 8:
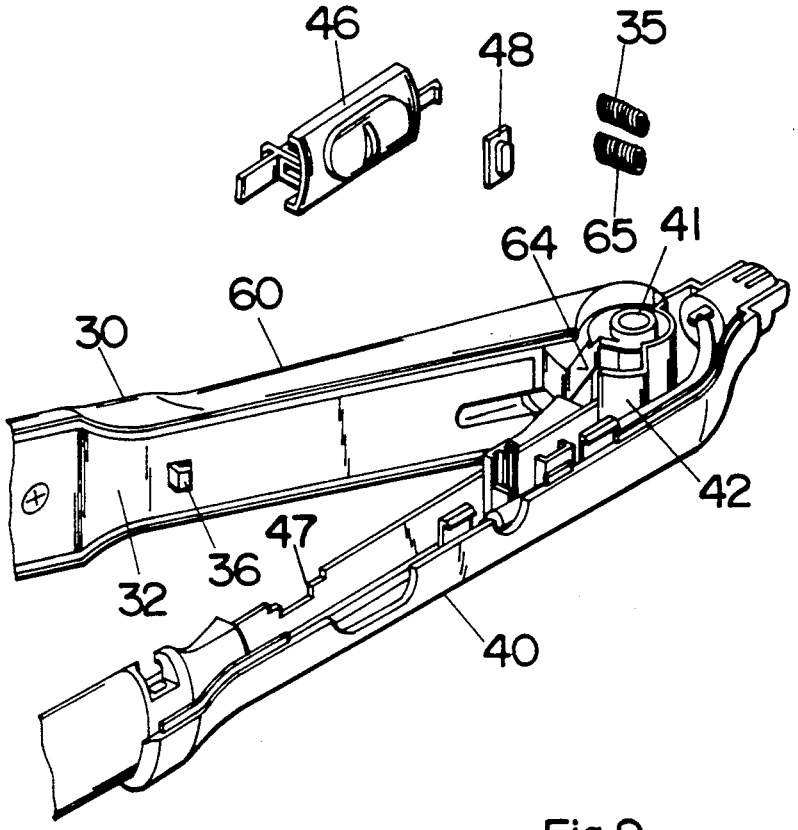
FIG. 8 is an exploded perspective view illustrating the above pivot coupling with a pair of springs shown as detached from the second handle.
Figure 9:
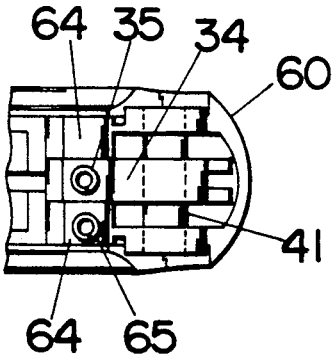
FIG. 9 is a partial view somewhat schematically illustrating portions of the first handle and the hair clamping tongue on which the two springs act, respectively.
Figure 11:
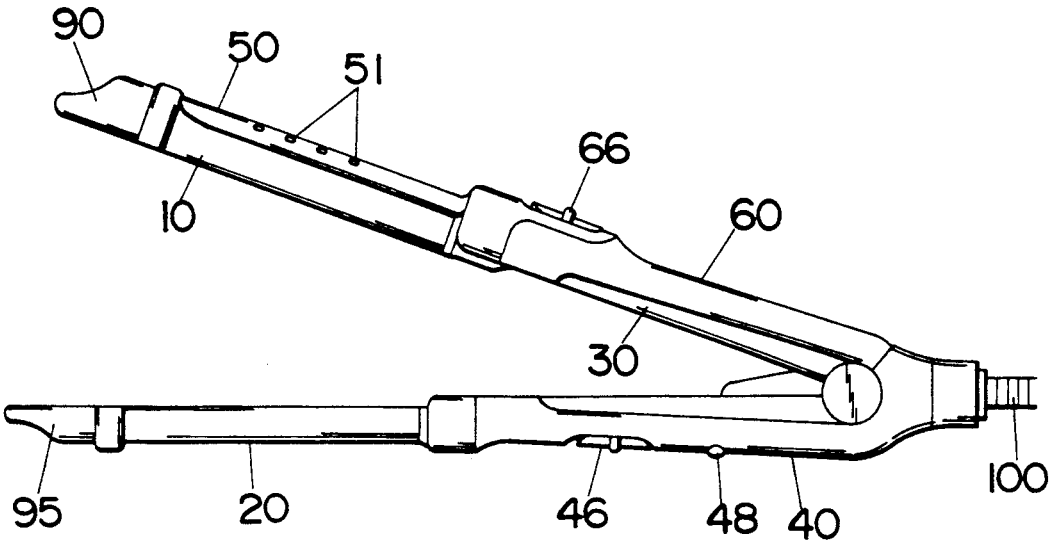
FIG. 11 is a front view of the hair styling iron shown in an open position ready for straightening the hair.

As shown in FIGS. 5 to 7, the first and second handle 30 and 40 are shaped into a semi-cylindrical outer configuration in correspondence to the first and second pipes 10 and 20. The second handle 40 is provided at its rear end with a transversely extending pivot pin 41 which penetrates through a hole 31 in the rear end of the first handle 30 as well as through holes 61 in the rear end of the clamp handle 60 so as to pivotally connect the first handle 30, the second handle 40 and the clamp handle 60 commonly about the pivot pin 41, as shown in FIG. 7, thus allowing the first pipe 10 to move between the closed and open positions as well as allowing the clamp tongue 50 to move between the closed and release positions. A bottom lid 32 is provided to close a bottom opening of the first handle 30. The holes 31 and 61 are formed in corresponding flanges 33 and 63 which extend from the rear ends of the first handle 30 and the clamp handle 60 and received within the rear end of the second handle 40, respectively. As best shown in FIG. 6, the clamp handle 60 has the two flanges 63 between which the flange 33 of the first handle 30 is positioned so that the clamp handle 60 and the first handle 30 are allowed to pivot commonly about the pivot pin 41. The flanges 33 and 63 are respectively formed with shoulders 34 and 64 which are in an opposed relation to a bottom of a recess 42 formed at the rear end of the second handle 40 adjacent the pivot pin 41. As shown in FIGS. 8 and 9, coil springs 35 and 65 are fitted respectively between one of the shoulders 64 of the clamp handle 60 and the bottom of the recess 42 and between the shoulder 34 of the first handle 30 and the bottom of the recess 42 such that the Clamp handle 60 and the first handle 30 are urged respectively together with the clamp tongue 50 and the first pipe 10 into the released position and the open position. Therefore, the clamp tongue 50 is normally kept in the released position, as shown in FIG. 1, in relation to the first and second pipes 10 and 20, while the first pipe 10 is normally kept in the open position, as shown in FIG. 11, in relation to the second pipe 20.

Figure 12:
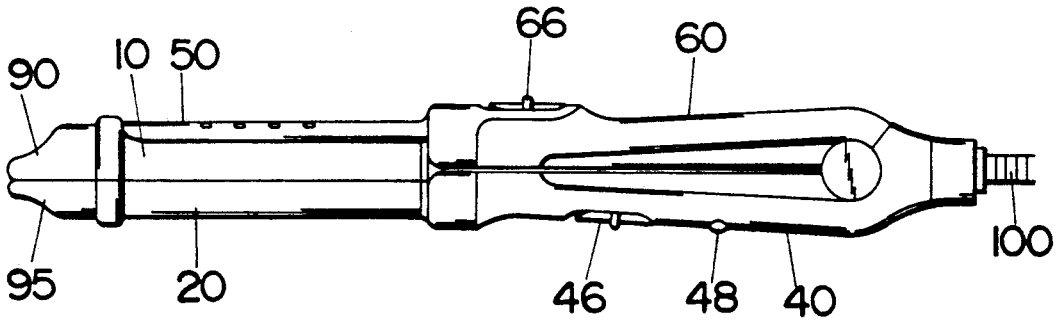
FIG. 12 is a front view of the hair styling iron shown in its closed position for effecting the hair straightening.

Provided on the bottom of the Second handle 40 is a slider lock 46 with a hook 47 which is engageable with a catch projection 36 on the lid 32 of the first handle 30 for locking the first handle 30 and therefore the first pipe 10 into the closed position relative to the second handle 40, as shown in FIG. 1. Likewise, the clamp handle 60 is provided with a slider lock 66 with a hook 67 which is engageable with a slit 37 in the upper surface of the first handle 30 for locking the clamp handle 60 and therefore the clamp tongue 50 into the clamp position, as shown in FIGS. 11 and 12. Thus, the hair curling operation can be conveniently performed by closing and opening the clamp tongue 50 with the first pipe 10 kept locked to the second pipe 20, as shown in FIGS. 1 and 12. On the other hand a hair straightening operation can be also conveniently performed by closing the first pipe 10 relative to the second pipe 20 with the clamp tongue 50 kept locked to the first pipe 10, as shown in FIGS. 11 and 12.

As shown in FIGS. 2 and 10, the first heater 70 in the first pipe 10 comprises a plate-like heater element 71 encased in a heat tube 72 of good thermal conductivity which is press-fitted within a cylindrical bore 11 of the first pipe 10. A pair of heat-conductive members 73 are disposed between the heater element 71 and the inner wall of the heat tube 72. The heat tube 72 has its entire circumference in contact with the wall of the bore 11, the top rounded outer surface and the bottom outer surface of the first pipe 10 for effectively heating the first pipe 10 uniformly. The heat tube 72 is closed at its front end to define thereto a steam generating surface 74. The second heater 80 comprises a plate-like heater element 81 disposed in the second tube 20 held in contact with the bottom outer surface by a support 81A for intensively heating thereof the bottom outer surface. Detachably attached to the front end of the first pipe 10 is a water tank 90 containing a volume of water and including a water carrying wick 91 extending axially rearward for contact with the steam generating surface 74 in order to supply the water thereto. The tank 90 is axially slidable and is biased forwardly by means of a spring 93 interposed between the wick 91 and the heat generating surface 74 so that the wick 91 is normally kept away from the heat generating surface 74 of the first heater 70. When the tank 90 is pushed inwardly against the bias of the spring 93, the wick 91 comes into contact with the heat generating surface 74 to supply the water thereto, thus generating steam thereato. The resulting steam is fed outwardly of the first pipe 10 through a number of minute vents 12 formed in the top and bottom outer surfaces for enhancing the hair styling of the hairs either clamped between the first pipe 10 and the clamp tongue 50 or held between the first and second pipes 10 and 20. The clamp tongue 50 is formed with a number of minute perforations 51 the steam to escape thererhrough. It is noted in this Connection that, as shown in FIG. 10, the first pipe 10 is configured to have a larger cross section than the second pipe 20 in order to provide a correspondingly larger space for accommodating the water tank and therefore increasing steam generating capacity. Provided at the front end of the second pipe 20 is a dummy cap 95 which resembles the water tank 90 and is likewise made retractable against the bias of a spring 96 held between the rear end of the dummy cap 95 and the heater element 81 of the second heater 80 such that the dummy cap 95 can be pushed in together with the water tank 90 for facilitating the push-in operation of the water tank 90 by the user.

The first and second heaters 80 and 90 are electrically connected through a suitable resistor or resistors to a power cord 100 extending outwardly through the rear end of the second handle 40. A pilot lamp 48 is inserted in a circuit of the heaters and is exposed in the outer surface of the second handle 40 for indication of the energization of the heaters.

Figure 13:
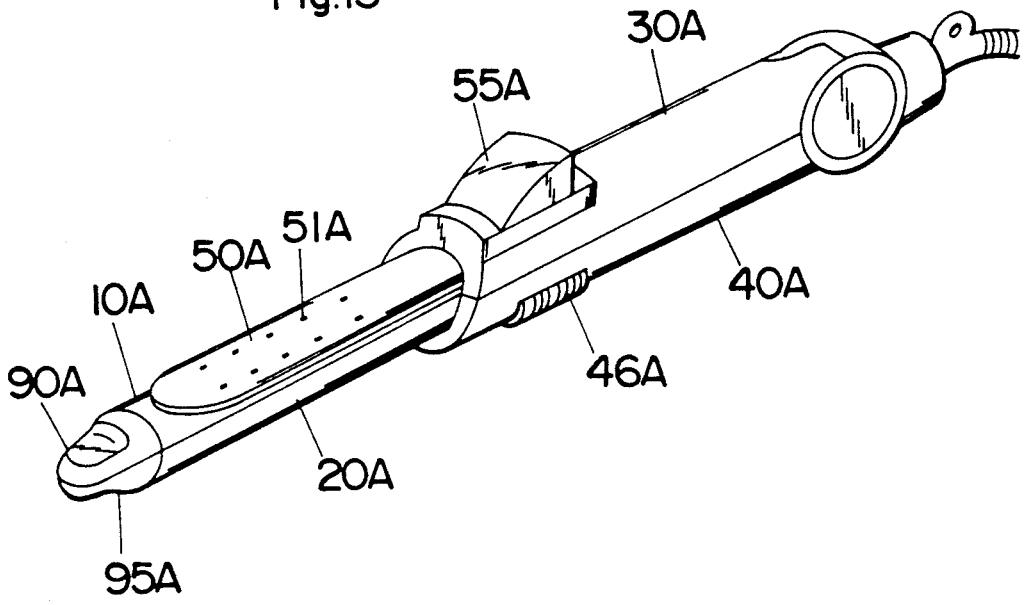
FIGS. 13 and 14 are perspective views of a hair styling iron, shown in closed and open positions, in accordance with a second embodiment of the present invention.
Figure 14:
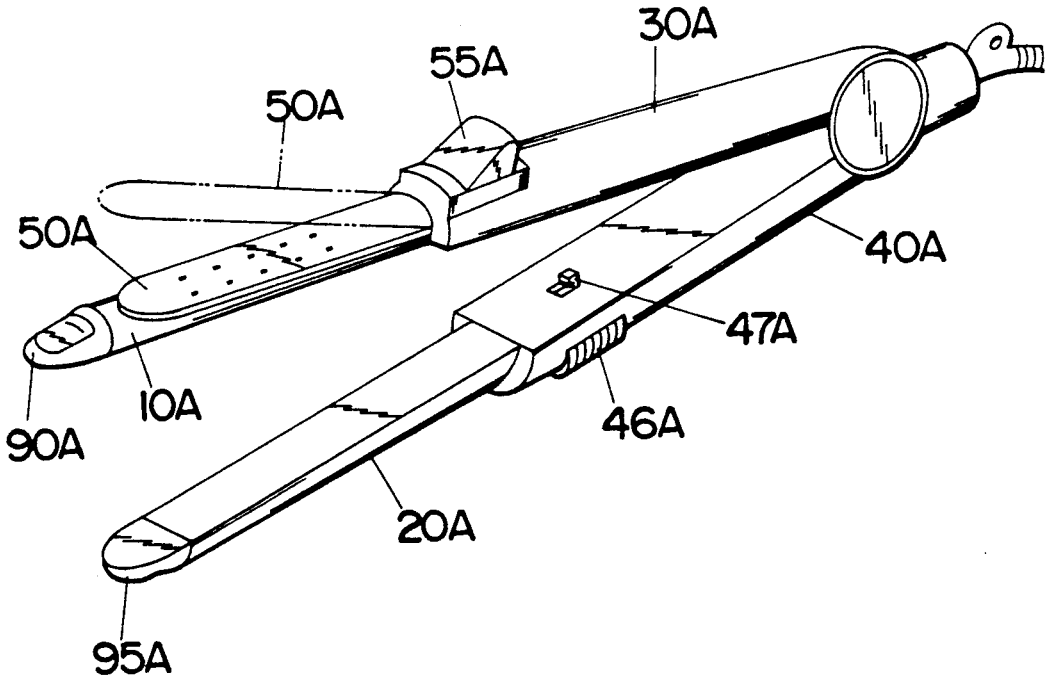

Second embodiment <FIGS. 13 and 14>

FIGS. 13 and 14 show a hair styling iron in accordance with a second embodiment of the present invention which is identical in structure and operation to those of the first embodiment except that a hair clamping tongue 50A is pivotally supported at the front end of the like first handle 30A. Like parts are designated by like numerals with a suffix letter "A". In this embodiment, the clamp tongue 50A is biased toward the clamp position on the first pipe 1OA and is caused to move away therefrom into the release position by manipulation of a thumb press 55A at the front end of the first handle 30A.

What is claimed is:

1. A hair styling iron comprising:

a pair of first and second pipes each having a generally semi-circular cross section with a top rounded outer surface and a bottom outer surface, means holding said first and second pipes for movement relative to each other between a closed position where said first end and second pipes have the outer bottom surfaces kept in closely adjacent relation to each other so as to hold therebetween a strand of hair for substantially straightening the hair and an open position where said outer bottom surfaces are kept away from each other, said first and second pipes in said closed position cooperating to form a barrel of a generally circular cross-section for winding therearound a strand of hair in order to curl the hair; and a heater incorporated in at least said first pipe for applying heat to the strand of hair wound around said barrel or held between said first and second pipes;

a hair clamping tongue movable relative to the top rounded outer surface of said first pipe between a clamping position of clamping therebetween the strand of hair wound about said barrel and a release position for unwinding the strand of hair;

said first pipe having a larger cross-section than said second pipe, said second pipe including a water supply means comprising a water tank with a water carrying wick extending into said first pipe toward said heater, said water tank being slidably attached to the tip of said first pipe so as to bring said water carrying wick into contact with said heater for generating steam when said water tank is pushed in, and a slider dummy cap slidably attached to the tip of said second pipe so that it is capable of being pushed in together with said water tank; a plurality of steam vents in said first pipe for venting steam.

2. A hair styling iron as set forth in claim 1, wherein said first and second pipes extend respectively from one end of each of first and second handles which form said holding means and which are pivotally connected at their other ends about a pivot axis so that said first and second pipes are allowed to pivot together with said first and second handles about said pivot axis, and said hair clamping tongue being coupled to said first handle to be movable relative thereto.

3. A hair styling iron as set forth in claim 1, wherein said first and second pipes extend respectively from one end of each of first and second handles which form said holding means and which are pivotally connected at their other ends about a pivot axis so that said first and second pipes are allowed to pivot together with said first and second handles about said pivot axis, and said hair clamping tongue is pivotally supported to said first handle commonly about said pivot axis so as to be capable of pivoting together therewith as well as independently therefrom.

4. A hair styling iron as set forth in claim 1, wherein said hair clamping tongue and said first pipe are spring-biased to said release position and said open position relative to said first pipe and to said second pipe, respectively, and said hair clamping tongue and said first pipe are capable of being locked to said clamping position and said closed position, respectively by clamp lock means and barrel lock means selectively engageable with the first pipe and second pipe respectively.

5. A hair styling iron comprising:

a pair of first and second pipes each having a generally semi-circular cross section with a top rounded outer surface and a flat bottom outer surface, said first pipe having a larger cross-section than said second pipe, means holding said first and second pipes for movement relative to each other between a closed position where said first and second pipes have said flat outer bottom surfaces kept in closely adjacent relation to each other so as to hold therebetween a strand of hair for substantially straightening the hair and an open position where said flat outer bottom surfaces are kept away from each other, said first and second pipes in said closed position cooperating to form a barrel of a generally circular cross-section for winding therearound a strand of hair in order to curl the hair; and a heater incorporated in at least said first pipe for applying heat to the strand of hair wound around said barrel or held between said first and second pipes;

a hair clamping tongue movable relative to the top rounded outer surface of said first pipe between a clamping position of clamping therebetween the strand of hair wound about said barrel and a release position for unwinding the strand of hair.

6. A hair styling iron as set forth in claim 5, wherein said first pipe is provided at its tip, adjacent said heater with water supply means for holding a volume of water for heating water supplied from said water supply means in order to generate steam and a plurality of vents formed in said first pipe for discharge of said steam.

* * * * *